US008677519B2

(12) United States Patent
Ina et al.

(10) Patent No.: US 8,677,519 B2
(45) Date of Patent: Mar. 25, 2014

(54) DRAINAGE CONNECTOR

(75) Inventors: Takamasa Ina, Tokoname (JP); Yasuhiro Kondo, Chita (JP); Keisuke Hirai, Tokyo (JP); Ken Hirabayashi, Tokai (JP); Ken Higuchi, Tokoname (JP); Masafumi Fukagawa, Chita (JP)

(73) Assignee: Lixil Corporation, Tokyo (JP)

( * ) Notice: Subject to any disclaimer, the term of this patent is extended or adjusted under 35 U.S.C. 154(b) by 699 days.

(21) Appl. No.: 12/864,795

(22) PCT Filed: Jan. 28, 2009

(86) PCT No.: PCT/JP2009/051336

§ 371 (c)(1),
(2), (4) Date: Jul. 27, 2010

(87) PCT Pub. No.: WO2009/096418

PCT Pub. Date: Aug. 6, 2009

(65) Prior Publication Data

US 2010/0313344 A1 Dec. 16, 2010

(30) Foreign Application Priority Data

Feb. 1, 2008 (JP) ..... 2008-022542
Feb. 12, 2008 (JP) ..... 2008-030138

(51) Int. Cl.
*E03D 11/00* (2006.01)

(52) U.S. Cl.
USPC ..... 4/431

(58) Field of Classification Search
USPC ..... 4/431–433, 252.1; 285/56–60
See application file for complete search history.

(56) References Cited

U.S. PATENT DOCUMENTS 5,819,326 A * 10/1998 Kobayashi et al. ..... 4/252.1
6,247,193 B1 * 6/2001 Riepl ..... 4/420
6,421,843 B1 * 7/2002 Mellinger et al. ..... 4/319
2006/0137085 A1 6/2006 Xiang et al.

FOREIGN PATENT DOCUMENTS

JP 38-2235 3/1963
JP 62-196269 12/1987
JP 7-42217 2/1995
JP 10-140639 5/1998

(Continued)

OTHER PUBLICATIONS

International Search Report for PCT/JP2009/051336 dated Feb. 24, 2009 (English and JP language version).

*Primary Examiner* — Gregory Huson
*Assistant Examiner* — Janie Christiansen
(74) *Attorney, Agent, or Firm* — Smith, Gambrell & Russell, LLP.

(57) ABSTRACT

A drainage connector communicates between a drain outlet of a toilet drainage path connected to a toilet bowl and a connecting port of a drain conduit led into a room equipped with a toilet body. The drainage connector includes a casing formed with a flow inlet connected to the drain outlet and a flow outlet connected to the port, and piping disposed in the casing. The piping has an upstream piping having an upstream opening communicating with the flow inlet and forming a downward flow path when the drain outlet communicates with the port and a downstream piping connected to the upstream piping and having a downstream opening open to the casing in a lateral direction along an inner surface of the casing so that flush water flows out in the lateral direction. The downstream piping forms an upward flow path when the drain outlet communicates with the port.

6 Claims, 11 Drawing Sheets

(56) References Cited

FOREIGN PATENT DOCUMENTS

| | | |
|---|---|---|
| JP | 2000-265530 | 9/2000 |
| JP | 2002-61262 | 2/2002 |
| JP | 2003-96891 | 4/2003 |
| JP | 2005-336890 | 12/2005 |
| JP | 2006-70617 | 3/2006 |
| JP | 2006-519326 | 8/2006 |
| JP | 2007-169963 | 7/2007 |
| JP | 2007-218038 | 8/2007 |

* cited by examiner

DRAINAGE CONNECTOR

TECHNICAL FIELD

The present invention relates to a drainage connector.

RELATED ART

Japanese Patent Application Publication Nos. JP-A-H07-42217 and JP-A-2007-218038 disclose conventional flushing toilets respectively. Each disclosed flushing toilet is provided with a toilet drainage path communicating with a downstream side of a toilet bowl and a retaining part formed in the toilet drainage path. Each disclosed flushing toilet is further provided with an air suction device which sucks air from the toilet drainage path.

The retaining part is closed by flush water flowing thereinto in each flushing toilet, whereby a closed space is defined in a part of the toilet drainage path at the upper stream side of the retaining part. Air in the closed space is sucked by the air suction device in a predetermined synchronous manner when the toilet is flushed. As a result, an amount of air in the toilet drainage path can efficiently be reduced promptly and an amount of flush water can be increased in the toilet drainage path. Thus, a siphon action can reliably be initiated promptly by a synergetic effect of the air suction from the toilet drainage path and flow of flush water into the toilet drainage path by supply of flush water. Accordingly, sewage can reliably be discharged from the toilet bowl by the siphon action.

However, since an outer circumferential surface of the toilet drainage path in which the retaining part is formed is exposed in each of the above-described conventional flushing toilets, dew condensation is easy to occur on the outer circumferential surface of the toilet drainage path. As a result, dew drops produced on the outer circumferential surface of the toilet drainage path would flow down onto the floor surface to penetrate into the floor surface, resulting in stain. Furthermore, since sound produced by the flush water flowing into the retaining part easily leaks outward, each disclosed flushing toilet lacks in silence.

SUMMARY

The present invention was made in view of the foregoing circumstances of the conventional art and a problem to be overcome is to provide a drainage connector which can realize a flushing toilet having an excellent usability.

The present invention provides a drainage connector which communicates between a drain outlet of a toilet drainage path connected to a downstream side of a toilet bowl formed in a toilet body and a connecting port of a drain conduit led into a room equipped with the toilet body, the drainage connector comprising a casing provided with a flow inlet connected to the drain outlet and a flow outlet connected to the connecting port, and an internal piping disposed in the casing, wherein the internal piping has an upstream piping having an upstream opening communicating with the flow inlet and forming a downward flow path when the drain outlet communicates with the connecting port and a downstream piping connected to the upstream piping and having a downstream opening open to an interior of the casing in a lateral direction along an inner surface of the casing so that flush water flows out in the lateral direction, the downstream piping forming an upward flow path when the drain outlet communicates with the connecting port. In other words, the downstream opening, which is open to the interior of the casing, is configured, relative to the interior of the casing, such that flush flowing out of the downstream opening impacts the interior of the casing with a circumferential flow component so as to generate a swirling flow within the casing.

In the drainage connector, a retaining part is formed in the internal piping when the drain outlet has communicated with the connecting port. Since the internal piping is disposed in the casing, an outer peripheral surface of the internal piping forming the retaining part is prevented from being exposed to an external air such that dew condensation cannot easily occur. Even if dew condensation should occur on the outer peripheral surface, the dew drops would fall in the casing thereby to be discharged through the flow outlet of the casing into the drain conduit. Accordingly, the dew drops can be prevented from penetrating into the floor surface to result in stain. Furthermore, quietness can be improved since leakage of the sound produced by flush water flowing into the retaining part is suppressed by the casing covering the internal piping. Accordingly, the drainage connector in accordance with the invention can realize a flushing toilet which has an excellent usability.

The downward flow path may include a lowermost part having an upper end and the upward flow path may include an uppermost part having a lower end, and the lower end of the uppermost part of the upward flow path may be located at an identical horizontal position with or higher than the upper end of the lowermost part of the downward flow path when the drain outlet communicates with the connecting port. In this case, the retaining part formed in the internal piping is completely closed by the flush water.

Accordingly, when the toilet is flushed, the toilet drainage path and the internal piping can be filled with the flush water promptly. Consequently, the siphon action can be caused promptly.

When a negative pressure is established at the downstream side of the drain conduit led into the room, influences of the negative pressure on the retaining part can be weakened since the casing is formed with an inner space spread wider than the flow outlet. Accordingly, the suction of flush water from the retaining part into the downstream side by the negative pressure in the drain conduit is suppressed, whereupon the sealing of the retaining part by the flush water is hard to break. Consequently, the closed space defined at the upstream side of the retaining part can be maintained and the siphon action can reliably occur promptly.

The casing may have an inner surface including a horizontal section that is substantially annular. In this case, the flush water flowing out through the downstream opening is discharged along the inner surface of the casing, while swirling, through the flow outlet. Consequently, the flush water can more smoothly be discharged out of the casing.

The casing may have an inner surface including a downwardly inclined surface directed toward the flow outlet thereof. In this case, the flush water flows downward along the downwardly inclined surface toward the flow outlet. Also, the downstream opening, which opens to the interior of the casing, is configured such that flush flowing out of the downstream opening impacts the interior of the casing with a circumferential flow component so as to generate a swirling flow within the casing. Additionally, the downstream opening is configured relative to the interior of the casing such that flush flowing out of the downstream opening has both a downward flow component and the circumferential flow component such that a downward swirling flow is initiated upon impact; and the interior of the casing has a surface that is inclined and extends radial inward such that the swirling flow is directed radially inward following impact. Consequently, the flush water can reliably be discharged out of the casing.

The casing may have an upper surface formed with the flow inlet and an underside formed with the flow outlet, and the flow inlet and flow outlet may both have respective centers aligned with each other. In this case, the drain outlet of the toilet drainage path is provided at the center of the toilet body in the right-left direction of the toilet body. The drain conduit is led into a central part of the room to be furnished with the toilet body, in the right-left direction of the room. Consequently, the toilet body can easily be installed in the central part of the room in the right-left direction.

A flushing toilet provided with the drainage connector may comprise an air suction device which sucks air from the internal piping at the upstream side of the retaining part and a closed space defined in the interior of the toilet drainage path. In this case, when the toilet is flushed, air is sucked from the closed space by the air suction device in a predetermined synchronous manner. As a result, the toilet drainage path and the interior of the internal piping can be filled with flush water further more promptly, whereupon the siphon action can be caused further more promptly.

The toilet drainage path comprises a first drainage path which continues into the downstream side of the toilet bowl and extends upward and a second drainage path which continues into the downstream side of the first drainage path and extends downward. The second drainage path includes a curved flow path which changes the direction of flow path from the horizontal direction to the vertical direction and a vertical flow path which continues into the downstream side of the curved flow path and extends in the vertical direction. A toilet drain conduit forming the second drainage path has a communication hole provided in a part of an upper surface of the curved flow path, which part is formed in an area located above the vertical flow path. The air suction device communicates with the communication hole.

In this case, the flush water with a downward impetus flows along the second drainage path in the vicinity of the communication hole. In particular, since the vertical flow path extends below the communication hole, the impetus of flush water flowing downward is increased. Accordingly, flush water and sewage are prevented from being easily sucked through the communication hole when air in the toilet drainage path is sucked by the air suction device. Consequently, the communication hole is prevented from being easily closed by the flush water or sewage, and air can reliably be sucked from the toilet drainage path. As a result, the siphon action can reliably be caused and sewage can reliably be discharged.

The toilet drainage conduit has a communication conduit extending vertically upward from the circumferential edge of the communication hole. The air suction device communicates with an upper end opening of the communication conduit. In this case, even if flush water or sewage flows into the communication conduit when air in the toilet drainage path is sucked by the air suction device, the flush water or the like cannot easily flow upward along the communication conduit into the air suction device. Furthermore, since the communication conduit extends vertically upward from the peripheral edge of the communication hole, the flush water or the like entering into the communication conduit easily falls downward when air suction by the air suction device is stopped. Accordingly, the communication hole or the interior of the communication conduit is prevented from being easily closed by the flush water or the like, whereupon the air suction device can desirably suck air in the toilet drainage path.

The communication conduit has a diameter of not less than 30 mm. In this case, an air suction force in the communication hole is not so high that the flush water or the like is hard to suck from the communication hole.

An air suction conduit provided on the air suction device and having an air suction hole in a lower end thereof is inserted into an upper end opening of the communication conduit with a packing being interposed therebetween. In this case, the air suction conduit of the air suction device can easily be connected to the communication conduit of the toilet drainage conduit in an airtight state, whereupon air can reliably be sucked from the toilet drainage path.

The toilet drainage conduit is discrete from the toilet body, and the toilet body has a connected opening which is formed by opening an uppermost part of an upward flow path. A connecting port formed in an upstream end of the toilet drainage conduit is connected to the connected opening. In this case, the toilet drainage conduit can be formed with high accuracy, and air can reliably be sucked from the toilet drainage path. Furthermore, since a lower end of the connected opening of the toilet body is located substantially at the same height as a water sealing surface of a water sealing part formed in the toilet body, the connection between the connected opening of the toilet body and the connecting port of the toilet drainage conduit is not normally soaked in the flush water. Consequently, the flush water can be prevented from leaking out of the aforementioned connection without an excessive leakage prevention structure.

DETAILED DESCRIPTION

Embodiments 1 to 5 of a flushing toilet will be described with reference to the drawings. The drainage connector in accordance with the present invention is applied to the flushing toilet.

Embodiment 1

Figure 1:
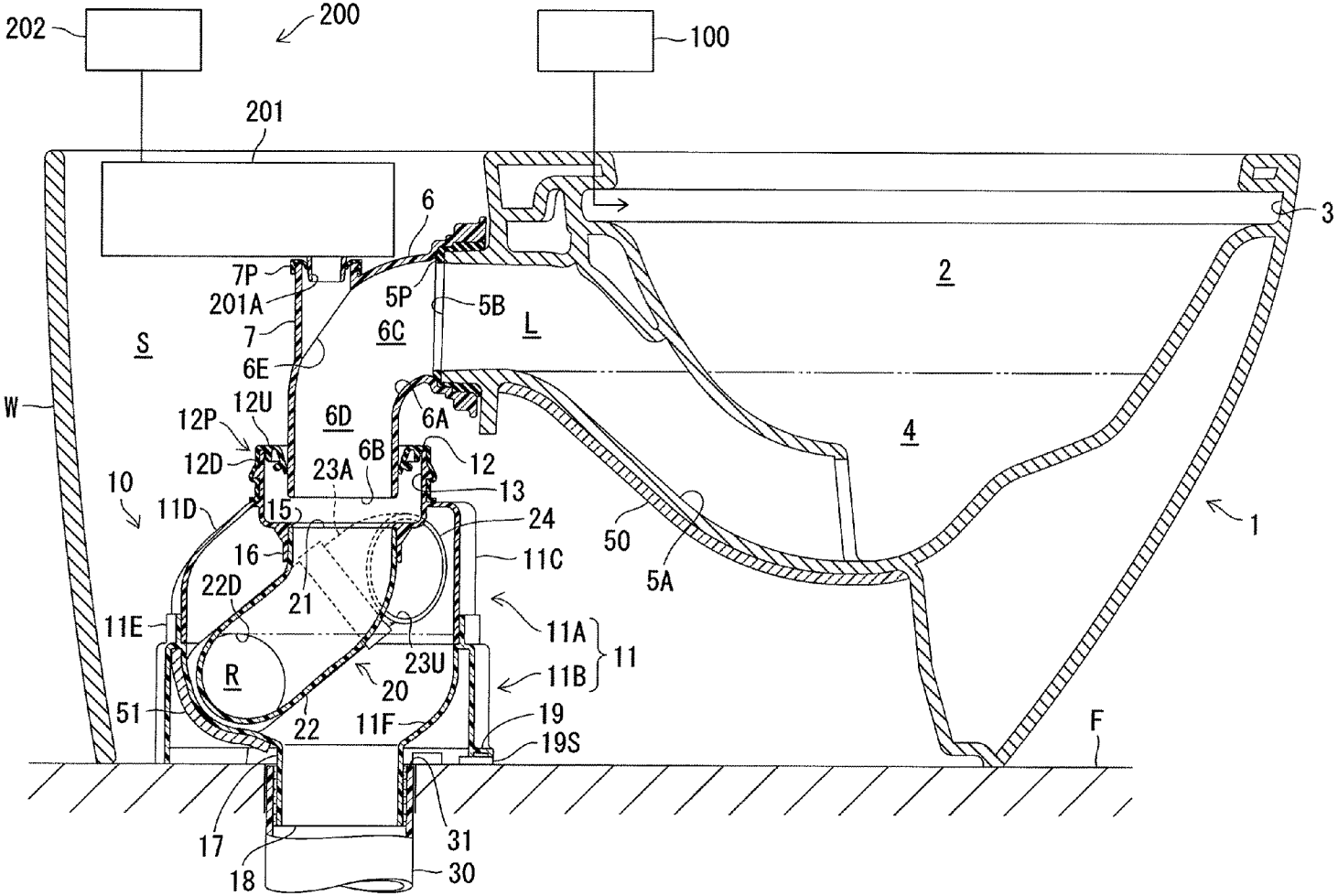
FIG. 1 is a sectional view of the flushing toilet in a first embodiment.

The flushing toilet of the first embodiment includes a toilet body 1, a toilet flushing device 100, an air suction device 200, a toilet seat and a toilet cover as shown in FIG. 1. The toilet flushing device 100 is connected to a water pipe which is not shown and has a strainer, a constant flow rate valve and an on-off valve. The air suction device 200 includes a suction tank 201 and a drive unit 202 which drives the suction tank 201. The toilet seat and the toilet cover are eliminated in the drawing.

The toilet body 1 has a rim 3 along an upper inner periphery of a toilet bowl 2. The toilet body 1 also has a water sealing part 4 in which flush water is reserved. A toilet drainage path L is connected to the downstream side of the toilet bowl 2. The toilet drainage path L comprises a first drainage path 5A and a second drainage path 6A. The first drainage path 5A is formed integrally with the toilet bowl 2 and communicates with the downstream side of the toilet bowl 2. The first drainage path 5A has a connected opening 5B which is formed in an uppermost downstream end so as to be open in the horizontal direction. The second drainage path 6A comprises a toilet drainage conduit 6 which is discrete from the toilet body 1. The toilet drainage conduit 6 is connected via a packing 5P to the connected opening 5B. A sheet heater 50 is affixed to undersides of the toilet bowl 2 and first drainage path 5A in order that flush water remaining in the toilet bowl 2 and the first drainage path 5A may be prevented from being frozen.

The toilet drainage conduit 6 has a drain outlet 6B which is formed in a downstream end thereof so as to be directed vertically downward. The toilet drainage conduit 6 also has a curved flow path 6C which changes the direction thereof from a horizontal direction to a vertical direction and a vertical flow path 6D which is continuous to the downstream side of the curved flow path 6C and extends in the vertical direction. The toilet drainage conduit 6 is provided with a communication hole 6E which is formed in a part of an upper face of the curved flow path 6C, which part is formed in an area located above the vertical flow path 6D. The toilet drainage conduit 6 further has a communication conduit 7 extending vertically upward from a peripheral edge of the communication hole 6E. The communication conduit 7 has an upper opening into which a suction conduit 201A of a suction tank 201 is inserted with a packing 7P being interposed therebetween so as to be connected to the communication conduit 7 in an airtight manner. Alternatively, an O-ring may be fitted on an outer periphery of the suction conduit 201A, which may be inserted into the communication conduit 7 in an airtight manner.

The drain outlet 6B communicates via a drainage connector 10 with a connecting port 31 of a drain conduit 30 led into a floor F of a room equipped with the toilet body 1. The drainage connector 10 comprises a casing 11 including an upper casing 11A and a lower casing 11B and an internal piping 20 disposed in the casing 11, as shown in FIGS. 1 to 4.

The upper casing 11A has a first connecting portion 13 which is cylindrical and extends vertically upward from an upper surface thereof. The first connecting portion 13 has an upper end formed into a flow inlet 12. The first connecting portion 13 has a lower part which extends down to below the upper surface of the upper casing 11A and has a centrally located circular opening 15 having a smaller diameter than the flow inlet 12. A downwardly extending columnar drooping wall 16 is formed on a lower part of the circumferential edge of the opening 15.

A packing 12P is attached to the flow inlet 12. The packing 12P includes a circular upper surface 12U formed with an opening 12K which has a smaller diameter than the toilet drainage conduit 6, and a trunk 12D extending downward from an outer circumferential edge of the upper surface 12U. The trunk 12D of the packing 12P has an inner circumferential surface formed with a recess which is engaged with and locked by a flange 14 formed on an outer circumferential surface of the first connecting portion 13. When to be connected to the drainage connector 10, the toilet drainage conduit 6 is inserted into the flow inlet 12 from above while the opening 12*k* of the packing 12P having attached to the flow inlet 12 is pushed thereby to be spread. As a result, the toilet drainage conduit 6 can easily be connected to the drainage connector 10.

The upper casing 11A also has a sidewall 11C extending downward from the circumferential edge of the upper surface thereof. The sidewall 11C has an inner surface having a generally annular horizontal side section. A part of the sidewall 11C is formed into an inclined face 11D, whereupon the size of the casing 11 can be reduced and a rear storage space S defined by a peripheral wall W of the toilet body 1 can be increased. Accordingly, the drive unit 202 for the air suction device 200 and the like can easily be stored in the rear storage space S.

The lower casing 11B has an outer wall 11E continuous to the sidewall 11C of the upper casing 11A and an inner wall 11F having an inner surface which is formed so as to be coplanar with the inner surface of the sidewall 11C. The inner wall 11F has a lower end provided with a second connecting portion 17 which is columnar and extends vertically downward. The second connecting portion 17 has a lower end formed into a flow outlet 18. The second connecting portion 17 is inserted into a connecting port 31 of the drain conduit 30 led into the floor F thereby to be connected to the drain conduit 30. The inner wall 11F has an outer surface formed into a downwardly inclined surface directed toward the flow outlet 18. The sheet heater 51 is affixed to the outer surface of the inner wall 11F.

Figure 2:
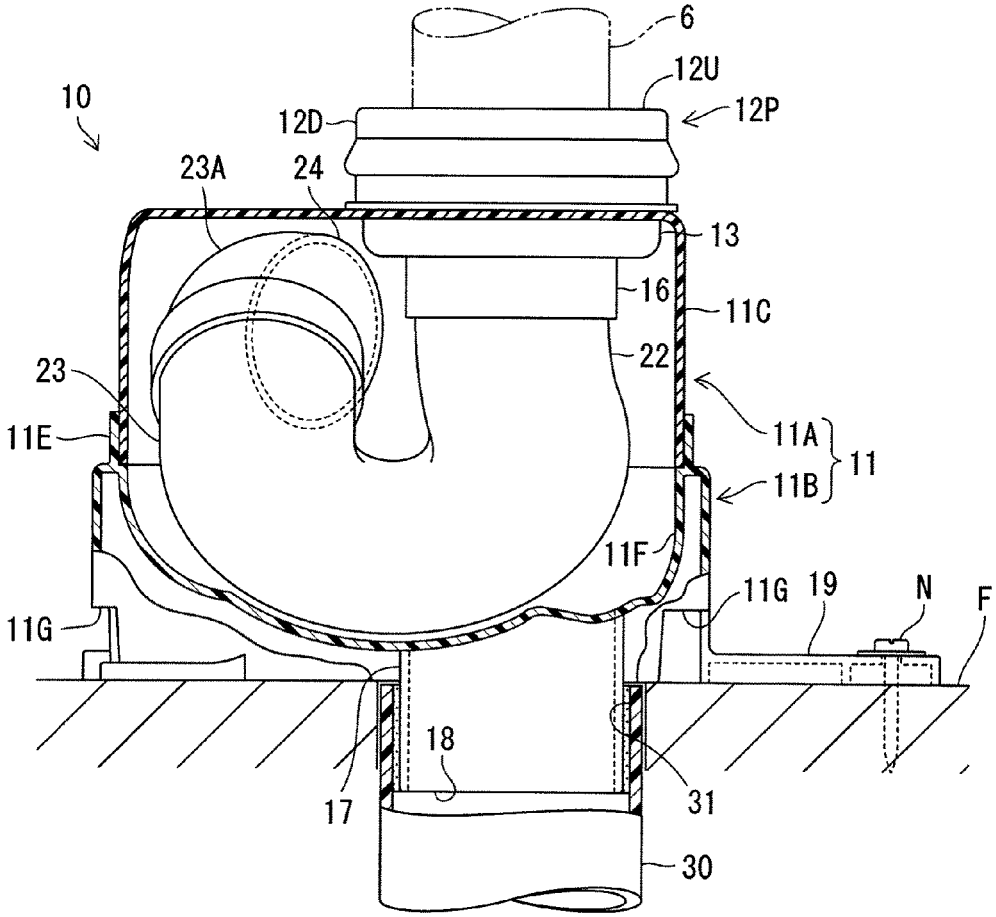
FIG. 2 is a sectional view of the drainage connector in the first embodiment.
Figure 3:
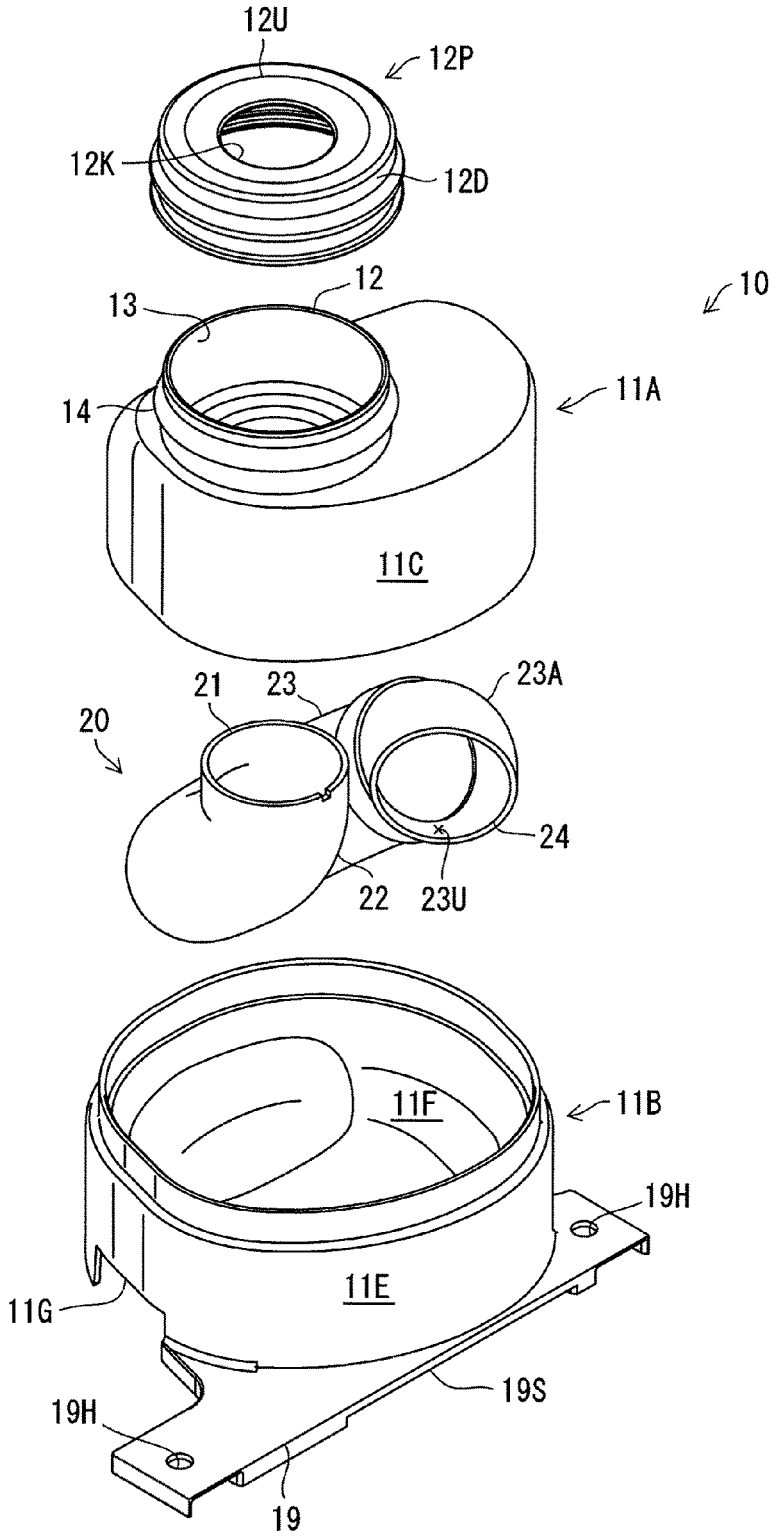
FIG. 3 is an exploded view of the drainage connector in the first embodiment.
Figure 4:
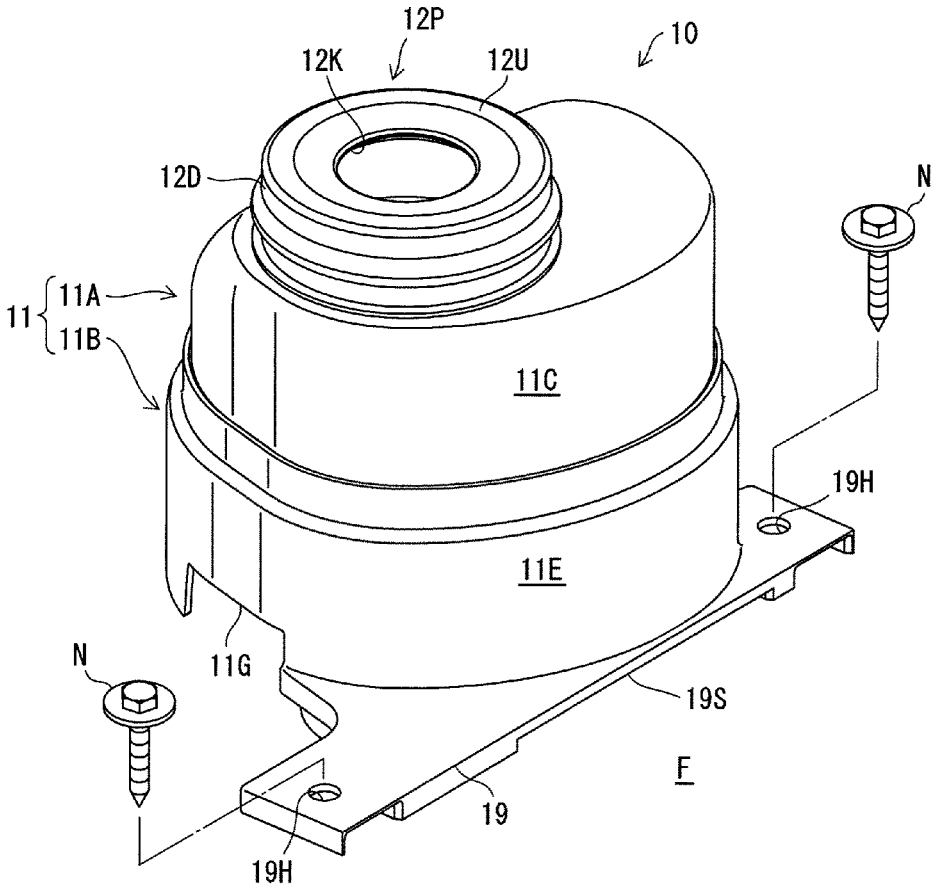
FIG. 4 is a perspective view of the drainage connector in the first embodiment.

The lower casing 11B has notches 11G formed in right and left lower ends thereof respectively as shown in FIGS. 2 to 4. When the drainage connector 10 is to be fixed to the floor F, it can be checked through the notches 11G if water or odor is leaking from the connection between the flow outlet 18 of the drainage connector 10 and the connecting port 31 of the drain conduit 30.

The lower casing 11B has a mounting strip 19 which is provided on a front of the lower end thereof so as to extend in the right-left direction. The mounting strip 19 has right and left ends formed with through holes 19H through which screws N are insertable to fix the casing 11 to the floor F, respectively. The mounting strip 19 also has an underside formed with a slit 19S which communicates with the inside of an outer wall 11E of the lower casing 11B. As a result, when the drainage connector 10 is to be detached from the floor F, a saw is inserted through the slit 19S to cut the second connecting portion 17, whereby the drainage connector 10 can be separated from the drain conduit 30.

The internal piping 20 disposed in the casing 11 has a flow inlet 21 formed in the upper end thereof, an upstream piping 22 forming a downward flow path, and a downstream piping 23 which is formed so as to be continuous to the upstream piping 22 and has a downstream opening 24 that is open to the interior of the casing 11 and forms an upward flow path, as shown in FIGS. 1 to 3. The upstream piping 22 has an upper end which is connected to the drooping wall 16 provided on the upper casing 11A. The upstream piping 22 is bent to rearward of the toilet body 1 below the connection to the drooping wall 16 and is then gradually curved laterally while extending obliquely downward, whereby a lowermost part is formed. The downstream piping 23 extends obliquely upward while being gradually curved from the lowermost part to the front side of the toilet body 1. The downstream piping 23 has a distal end 23A which is connected to a distal end thereof and formed with the downstream opening 24 which is along the inner surface of the casing 11 and open slightly obliquely downward. An uppermost part of the upward flow path is formed at the upstream side of the downstream opening 24.

The uppermost part of the upward flow path has a lower end 23U which is located above an upper end 22D of a lowermost part of the downstream flow path, as shown in FIG. 1. Accordingly, a retaining part R formed in the internal piping 20 is sealed by flush water. As a result, closed spaces are defined in a toilet drainage path L at the downstream side of a water sealing part 4 and an internal piping 20 at the upstream side of the retaining part R respectively.

Since the internal piping 20 forming the retaining part R is disposed in the casing 11, the outer peripheral surface of the internal piping 20 forming the retaining part R is prevented from being exposed to an external air such that dew condensation cannot easily occur, as shown in FIGS. 1 and 2. Even if dew condensation should occur on the outer peripheral surface of the internal piping 20, the dew drops would fall in the casing 11 thereby to be discharged through the flow outlet 18 of the casing 11 into the drain conduit 30. Accordingly, the dew drops can be prevented from penetrating into the floor F to result in stain. Furthermore, quietness can be improved since leakage of the sound produced by flush water flowing into the retaining part R is suppressed by the casing 11 covering the internal piping 20. Accordingly, the drainage connector 10 in accordance with embodiment 1 can realize a flushing toilet which has an excellent usability.

The flow inlet 12 provided in the upper casing 11A and the flow outlet 18 provided in the lower casing 11B have respective centers located on the same vertically extending straight line when the drainage connector 10 is installed on the floor F. Accordingly, the toilet body 1 can easily be installed in the central part of the room in the right-left direction when the drain outlet 6 of the toilet drainage path L is provided at the center of the toilet body 1 in the right-left direction of the toilet body 1 and the drain conduit 30 is led into a central part of the room to be furnished with the toilet body 1, in the right-left direction of the room.

Furthermore, since the atmosphere in the casing 11 is heated by the sheet heater 51 affixed to the outer surface of the inner wall 11F of the lower casing 11B, the flush water in the retaining part R can be prevented from being frozen.

Even when a negative pressure is established at the downstream side of the drain conduit 30, influences of the negative pressure on the retaining part R can be weakened since the casing 11 is formed with an inner space spread wider than the flow outlet 18. Accordingly, the suction of flush water from the retaining part into the downstream side by the negative pressure in the drain conduit is suppressed, whereupon the sealing of the retaining part R by the flush water is hard to break. Consequently, the closed space defined at the upstream side of the retaining part R can be maintained and the siphon action can reliably occur promptly.

When the flushing toilet constructed as described above is to be flushed, flush water is supplied to the rim 3 by the toilet flushing device 100. The level of flush water is then increased in the toilet bowl 2. When a predetermined amount of flush water is supplied so that a predetermined water level is reached in the toilet bowl 2, the drive unit 202 of the air suction device 200 drives the suction tank 201. When air is sucked from the closed spaces formed at the downstream side of the water sealing portion 4 and in the toilet drainage path L at the upstream side of the retaining part R, the toilet drainage path L and the internal piping 20 are filled with the flush water, whereupon the siphon action is reliably caused promptly.

The flush water is supplied to the rim 3 by the toilet flushing device 100 for a predetermined period of time after occurrence of the siphon action. The siphon action continues while the flush water is supplied at a predetermined flow rate, whereby sewage in the toilet bowl 2 is discharged. Subsequently, the drive unit 202 of the air suction device 200 drives the suction tank 201 so that air is discharged from the suction tank 201 into the toilet drainage path L. As a result, the siphon action is terminated. After termination of the siphon action, flush water is supplied to the water sealing portion 4 of the toilet body 1, whereby the water sealing is completed.

When flowing from the downstream opening 24 of the internal piping 20 into the casing 11, the flush water is discharged from the flow outlet 18 into the drain conduit 30 while swirling along the inner surface of the casing 11. Accordingly, since the flush water is smoothly discharged out of the casing 11, the siphon action can be continued and sound produced by the flowing of flush water can be reduced. Furthermore, since the inner wall 11F of the lower casing 11B is formed into the downwardly inclined surface directed toward the flow outlet 18, the flush water flows downward toward the flow outlet 18 thereby to be reliably discharged out of the casing 11.

Embodiment 2

Figure 5:
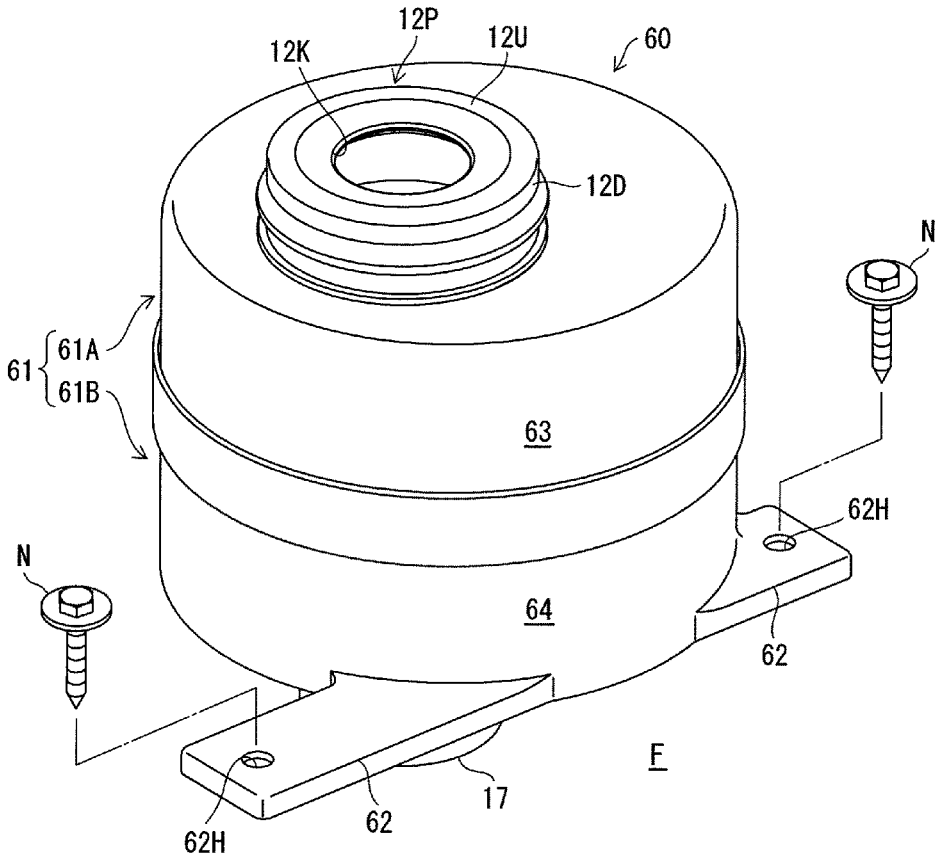
FIG. 5 is a perspective view of the drainage connector in a second embodiment.

The flushing toilet in accordance with embodiment 2 is directed to a change in the shape of the casing of the drainage connector. Identical or similar parts in embodiment 2 are labeled by the same reference symbols as those in embodiment 1, and detailed description of these parts will be eliminated. The casing 61 of the drainage connector 60 comprises the upper casing 61A and the lower casing 61B as shown in FIGS. 5 and 6.

The upper casing 61A has an upper circular surface and a cylindrical sidewall 63 extending downward from the circumferential edge of the upper surface. The sidewall 63 has an inner surface having a horizontal section which is substantially annular. The lower casing 61B has a sidewall 64 continuous to the sidewall 63 of the upper casing 61A. The lower casing 61B has a pair of mounting strips 62 provided on a front portion of the lower end of the sidewall 64 and extend in the right-left direction. Each mounting strip 62 has a through hole 62H through which a screw N for fixing the casing 61 to the floor F can be inserted.

Figure 6:
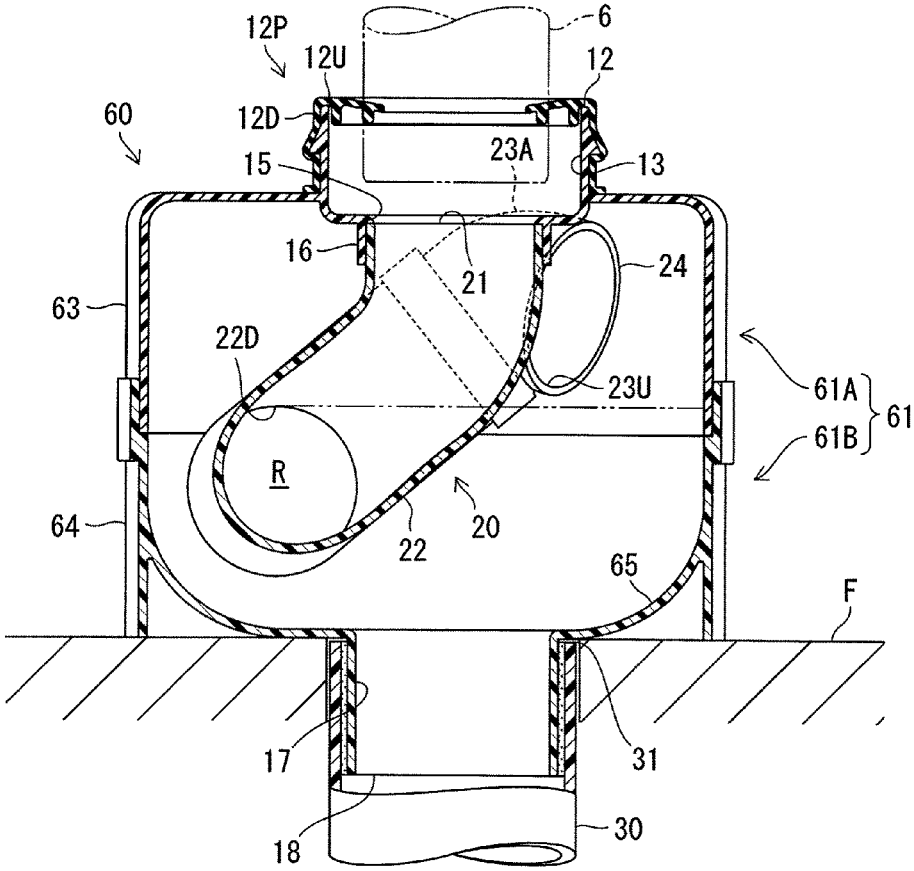
FIG. 6 is a sectional view of the drainage connector in the second embodiment.

The sidewall 64 of the lower casing 61B has an inner surface formed with a downwardly inclined surface 65 directed from a vertical middle thereof toward the flow outlet 18 as shown in FIG. 6. The second connecting portion 17 is formed so as to be continuous to the lower end of the inclined surface 65.

Since the internal piping 20 forming the retaining part R is disposed in the casing 61, the outer peripheral surface of the internal piping 20 is prevented from being exposed to the external air such that dew condensation cannot easily occur. Even if dew condensation should occur on the outer peripheral surface of the internal piping 20, the dew drops would fall in the casing 61 thereby to be discharged through the flow outlet 18 of the casing 61 into the drain conduit 30. Accordingly, the dew drops can be prevented from penetrating into the floor F to result in stain. Furthermore, quietness can be improved since leakage of the sound produced by flush water flowing into the retaining part R is suppressed by the casing 61 covering the internal piping 20. Accordingly, the drainage connector 60 in accordance with embodiment 2 can realize a flushing toilet which has an excellent usability.

Since the inner surface of the casing 61 has a horizontal section that is circular, the flush water flowing from the downstream opening 24 of the internal piping 20 into the casing 61 is discharged from the flow outlet 18 into the drain conduit 30 while swirling along the inner surface of the casing 61.

Accordingly, the flush water can smoothly be discharged out of the casing 61, and sound produced by the flowing of flush water can be reduced. Furthermore, since the lower casing 61B is formed with the downwardly inclined surface 65 directed toward the flow outlet 18, the flush water flows downward toward the flow outlet 18 thereby to be reliably discharged out of the casing 61.

Embodiment 3

Figure 7:
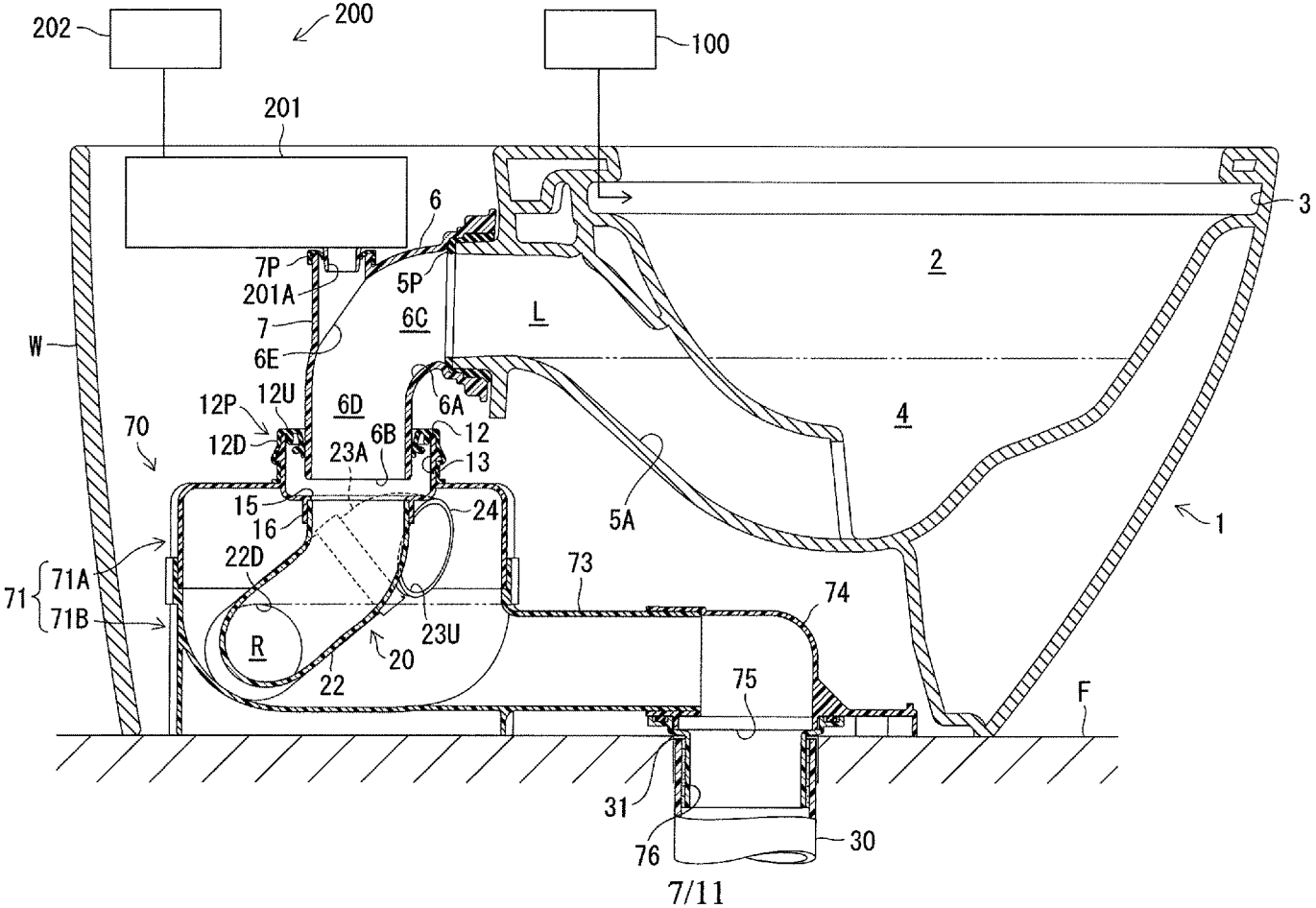
FIG. 7 is a sectional view of the flushing toilet in a third embodiment.
Figure 8:
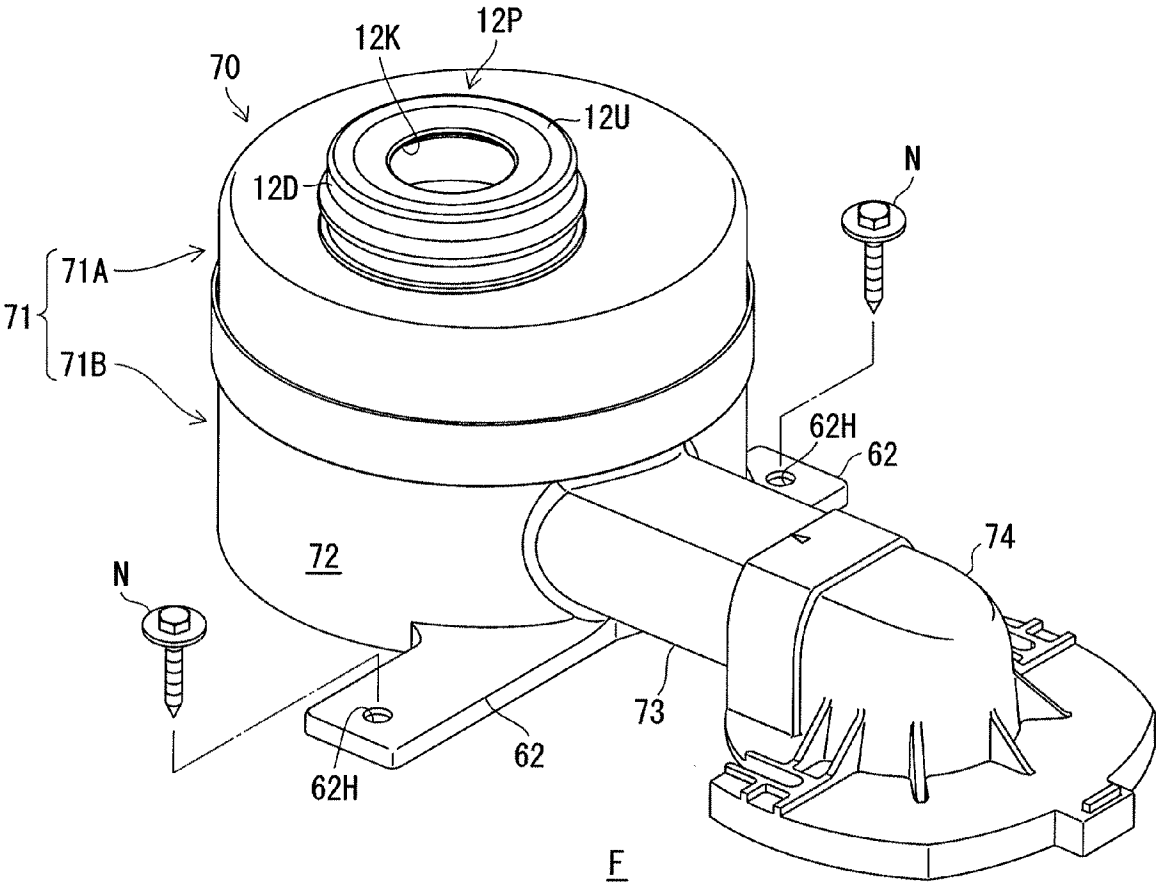
FIG. 8 is a perspective view of the drainage connector in the third embodiment.

The flushing toilet in accordance with embodiment 3 is directed to a change in the shape of the casing of the drainage connector. Identical or similar parts in embodiment 3 are labeled by the same reference symbols as those in embodiment 1 or 2, and detailed description of these parts will be eliminated. The casing 71 of the drainage connector 70 comprises the upper casing 71A and the lower casing 71B as shown in FIGS. 7 and 8.

The uppercasing 71A has the same construction as the upper casing 61A in embodiment 2. The lower casing 71B has a lateral piping 73 which is connected to the sidewall 72 and extends laterally. The lateral piping 73 has a connecting member 74 which is connected to a distal end thereof and formed with a downwardly opening flow outlet 75. The flow outlet 75 is connected to the drainage conduit 30 via a joining member 76 inserted into the connecting port 31 of the drainage conduit 30.

Since the internal piping 20 forming the retaining part R is disposed in the casing 71, the outer peripheral surface of the internal piping 20 is prevented from being exposed to the external air such that dew condensation is hard to cause. Even if dew condensation should occur on the outer peripheral surface of the internal piping 20, the dew drops would fall in the casing 71 thereby to be discharged from the flow outlet 75 through the lateral piping 73 of the casing 71 into the drain conduit 30. Accordingly, the dewdrops can be prevented from penetrating into the floor F to result in stain. Furthermore, quietness can be improved since leakage of the sound produced by flush water flowing into the retaining part R is suppressed by the casing 71 covering the internal piping 20. Accordingly, the drainage connector 70 in accordance with embodiment 3 can realize a flushing toilet which has an excellent usability.

When the toilet body is to be replaced by another, the toilet bodies differ from each other in the location of the drain conduit 30 led into the room depending upon the specification of the toilet body to be replaced. In this case, the toilet body can easily be replaced since the flow outlet 75 can be connected to the connecting port 31 of the drain conduit 30 by cutting the lateral piping 73 to a suitable length.

Reference Example

Figure 9:
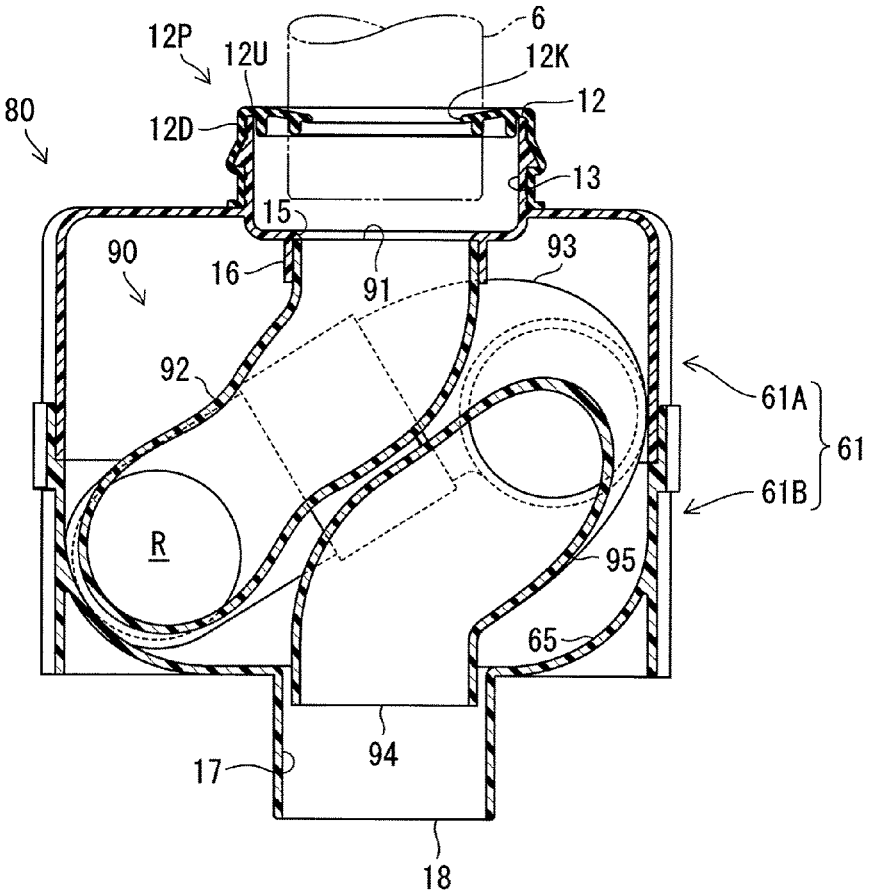
FIG. 9 is a sectional view of the drainage connector in a reference example.

The flushing toilet in accordance with a reference example is directed to a change in the shape of the inner piping of the drainage connector. Identical or similar parts in the reference example are labeled by the same reference symbols as those in embodiment 1 or 2, and detailed description of these parts will be eliminated. The internal piping 90 of the drainage connector 80 has a downstream opening 94 which is open to the flow outlet 18 provided in the lower casing 61B as shown in FIG. 9.

The internal piping 90 has the flow inlet 91 in the upper end thereof and comprises the upstream piping 92 forming the downward flow path and the downstream piping 93 which is provided so as to be continuous to the upstream piping 92. The downstream piping 93 forms the upward flow path and downward flow path continuous to the downstream side of the upward flow path. Since a lower end of the downstream piping 93 is inserted into the second connecting portion 17 of the casing 61, the downstream opening 94 of the internal piping 90 is open toward the flow outlet 18.

Since the internal piping 90 forming the retaining part R is disposed in the casing 61, the outer peripheral surface of the internal piping 90 is prevented from being exposed to the external air such that dew condensation is hard to cause. Even if dew condensation should occur on the outer peripheral surface of the internal piping 90, the dew drops would fall in the casing 61 thereby to be discharged from the flow outlet 18 of the casing 61 into the drain conduit 30. Accordingly, the dew drops can be prevented from penetrating into the floor F to result in stain. Furthermore, quietness can be improved since leakage of the sound produced by flush water flowing into the retaining part R is suppressed by the casing 61 covering the internal piping 90. Accordingly, the drainage connector in accordance with the reference example can realize a flushing toilet which has an excellent usability.

Furthermore, since the flush water flowing out of the downstream opening 94 is directly discharged into the flow outlet 18, almost no sound is produced in the casing 61 by the flowing of flush water, whereupon the quietness can further be improved.

Embodiment 4

The flushing toilet in accordance with embodiment 4 is directed to an embodiment of a suction tank 201 of the air suction device 200 and a change in the configuration of the toilet drainage conduit 6. Identical or similar parts in embodiment 4 are labeled by the same reference symbols as those in embodiment 1 or the like, and detailed description of these parts will be eliminated.

Figure 10:
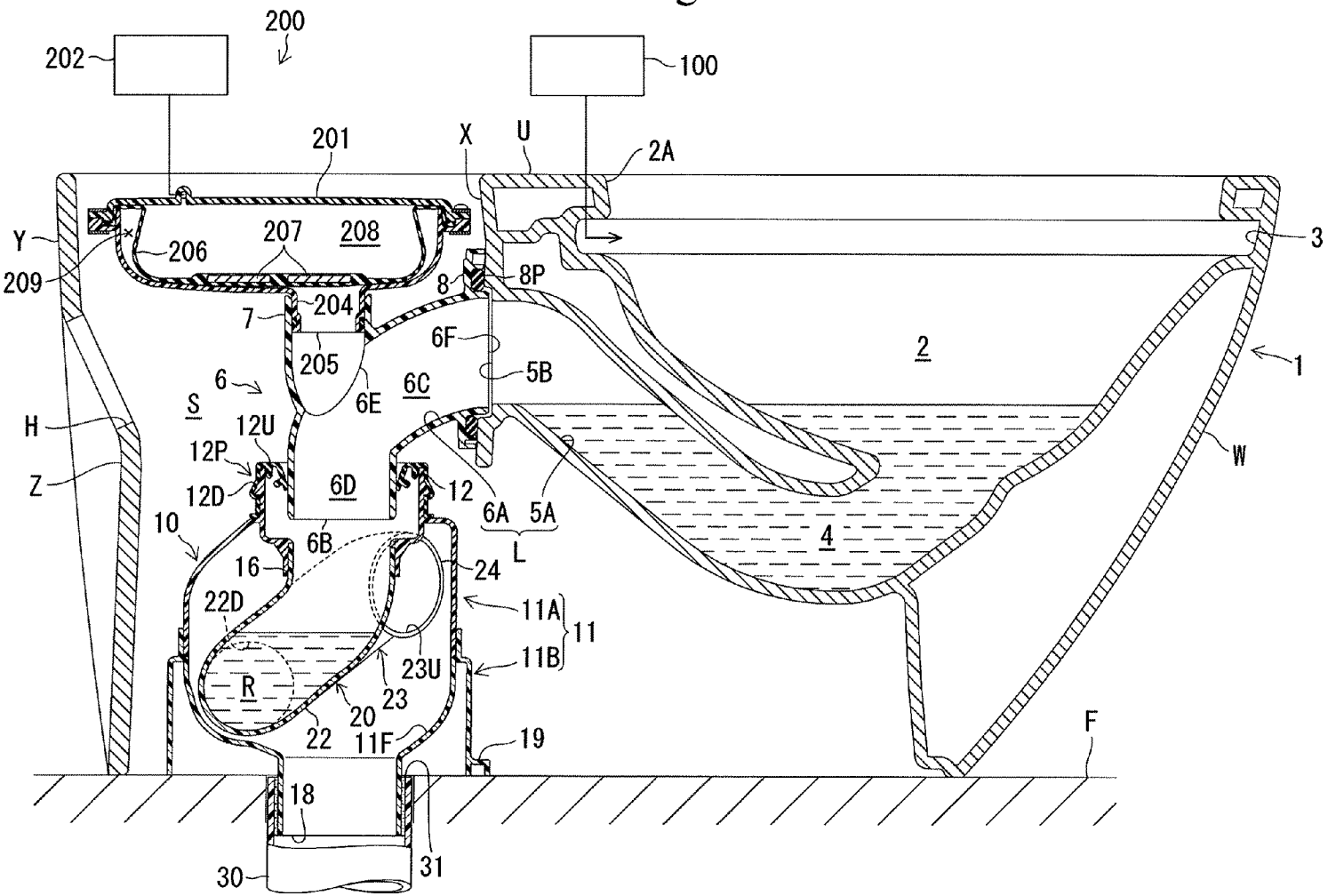
FIG. 10 is a sectional view of the flushing toilet in a fourth embodiment.

The suction tank 201 of embodiment 4 has an interior divided into an upper chamber 208 and a lower chamber 209 by a vertically movable diaphragm 206 as shown in FIG. 10. A weight 207 is embedded in the diaphragm 206. The air suction device 200 has a drive unit 202 which communicates with the upper chamber 208 and sucks air in the upper chamber 208 or discharges air into the upper chamber 208 thereby to vertically move the diaphragm 206.

The toilet body 1 has a top plate U which connects an upper end of the toilet bowl 2 and an upper end of the peripheral wall W. The top plate U has an opening 2A which opens the upper side of the toilet bowl 2. The top plate U has a rear edge provided with a reinforcement wall X drooping downward.

The peripheral wall W includes a front wall covering a front of the toilet bowl 2, a pair of right and left walls extending from right and left ends of the front wall behind the reinforcement wall X respectively, and a rear wall Y connecting rear ends of the right and left walls respectively. The toilet body 1 is provided with a storage space S which is surrounded by the right and left walls located behind the reinforcement wall X and the rear wall Y and extends vertically through the toilet body 1.

The rear wall Y has a recess Z formed in a central part thereof so as to extend oblong from the lower end. The recess Z has an upper portion provided with an opening H which is directed inwardly obliquely upward from the outside of the rear wall Y. A water supply conduit (not shown) is inserted through the opening H and has one of two ends that is connected to a water piping and the other end that is connected to the toilet flushing device 100.

A connected opening 5B which is a downstream end of the first drainage path 5A is provided in the reinforcement wall X of the toilet body 1. The connected opening 5B is formed so as to be sunken relative to the reinforcement wall X. A connecting opening 6F of an upstream end of the toilet drainage conduit 6 which is discrete from the toilet body 1 is fitted in the connected opening 5B. The toilet drainage conduit 6 has an upstream end which has a flange 8 formed on an outer periphery thereof. The connecting opening 6F is connected via an O-ring 8P serving as a packing to the connected opening 5B in an airtight manner so that the openings 6F and 5B are located between the flange 8 and the reinforcement wall X of the peripheral edge of the connected opening 5B.

Figure 11:
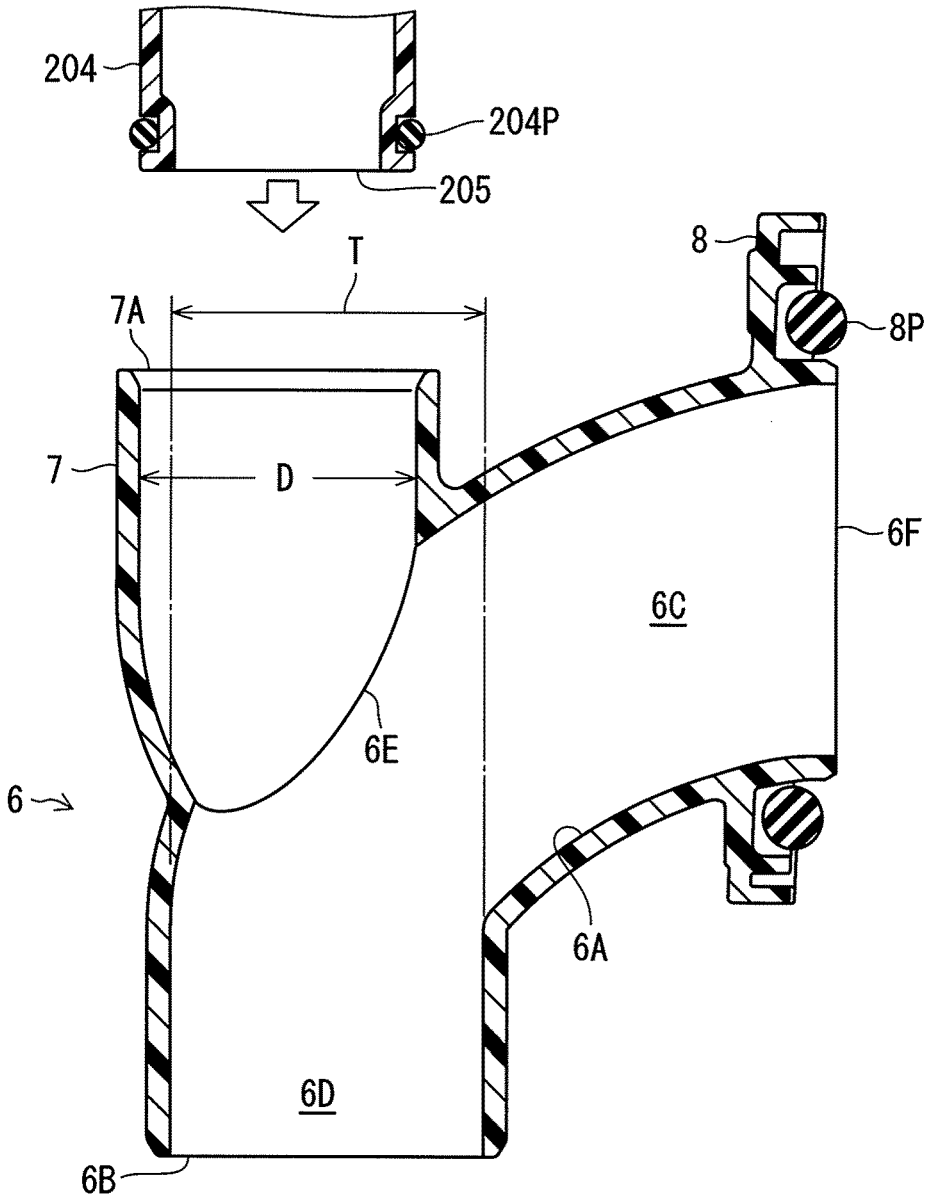
FIG. 11 is a sectional view of a toilet drainage conduit used in the flushing toilet in the fourth embodiment.

The toilet drainage conduit 6 forms a second drainage path 6A comprising the curved flow path 6C which changes the direction thereof from a horizontal direction to a vertical direction and a vertical flow path 6D which is continuous to the downstream side of the curved flow path 6C and extends in the vertical direction, as shown in FIG. 11. The toilet drainage conduit 6 also has a communication hole 6E which is formed in a part of an upper face of the curved flow path 6C, which part is formed in an area T located above the vertical flow path 6D. The toilet drainage conduit 6 further has a communication conduit 7 extending vertically upward from a peripheral edge of the communication hole 6E. The communication conduit 7 has a diameter of 50 mm.

The communication conduit 7 has an upper end opening 7A into which an air inlet piping 204 provided on the underside of the suction tank 201 is inserted. The air inlet piping 204 has a distal end formed with an air inlet 205. An O-ring 204P serving as a packing is fitted with a lower outer circumferential surface of the air inlet piping 204. As a result, the air inlet piping 204 can easily be connected to the communication conduit 7 in an airtight manner when just inserted into the communication conduit 7.

The communication conduit 7 extends vertically upward. Accordingly, even if flush water or sewage should enter through the communication hole 6E into the communication conduit 7, the flush water or the like would not be allowed to move upward through the communication conduit 7 into the suction tank 201. Furthermore, the flush water or the like having entered into the communication conduit 7 tends to easily fall out of the communication hole 6E when air suction from the suction tank 201 is stopped. Accordingly, the communication hole 6E and the communication conduit 7 are not easily closed by the flush water or the like, whereupon the suction tank 201 can successfully suck air from the toilet drainage path L. Furthermore, since the communication conduit 7 has the diameter of 50 mm, an air suction force of the communication hole 6E is not so strong as to suck the flush water or sewage from the communication hole 6E. Furthermore, since the toilet drainage conduit 6 is discrete from the toilet body 1, the toilet drainage conduit 6 can accurately be formed, whereupon air can reliably be sucked from the toilet drainage path L. Furthermore, the lower end of the connected opening 5B of the toilet body 1 is located substantially at the same level as the water sealing surface of the water sealing portion 4 formed in the toilet body 1. Accordingly, the connection between the connected opening 5B and the connecting opening 6F is normally prevented from being soaked in the flush water. Consequently, the flush water can be prevented from leaking out of the connection without provision of an excessive water leakage preventing structure.

When the flushing toilet constructed as described above is to be flushed, flush water is supplied to the rim 3 by the toilet flushing device 100. The level of flush water is then increased in the toilet bowl 2. When a predetermined amount of flush water is supplied so that a predetermined water level is reached in the toilet bowl 2, the drive unit 202 of the air suction device 200 moves upward the diaphragm 206 of the suction tank 201. When air is sucked from the closed spaces formed at the downstream side of the water sealing portion 4 and in the toilet drainage path L at the upstream side of the retaining part R, the toilet drainage path L and the internal piping 20 are filled with the flush water, whereupon the siphon action is reliably caused promptly.

In this case, the flush water with a downward impetus flows along the second drainage path 6A in the vicinity of the communication hole 6E of the toilet drainage conduit 6. In particular, since the vertical flow path 6D extends below the communication hole 6E, the impetus of flush water flowing downward is increased. Accordingly, flush water and sewage are difficult to suck through the communication hole 6E when air in the closed spaces is sucked from the communication hole 6E by the air suction device 200. Consequently, the communication hole 6E and the communication conduit 7 are not easily closed by the flush water or sewage, and air can reliably be sucked from the closed spaces. As a result, the siphon action can reliably be caused and sewage can reliably be discharged.

Although having been described by way of embodiments 1 to 4, the invention should not be limited by the foregoing embodiments but may be changed without departing from the scope thereof. For example, the retaining part R formed in the inner piping may not be normally sealed. In this case, a space along which air flows may be defined above the flush water in the retaining part R, and when flush water is supplied into the retaining part R in the toilet flushing, the space is sealed such that a sealed space is formed at the upstream side of the retaining part R. Furthermore, the air suction device which sucks air from the toilet drainage path L may not be provided. Additionally, the diameter of the communication conduit may be not less than 30 mm.

The invention claimed is:

1. A drainage connector which communicates between a drain outlet of a toilet drainage path connected to a downstream side of a toilet bowl formed in a toilet body and a connecting port of a drain conduit led into a room equipped with the toilet body, the drainage connector comprising:

a casing provided with a flow inlet connected to the drain outlet and a flow outlet connected to the connecting port; and an internal piping disposed in the casing, wherein the internal piping has an upstream piping having an upstream opening communicating with the flow inlet and forming a downward flow path when the drain outlet communicates with the connecting port and a downstream piping connected to the upstream piping and having a downstream opening open to an interior of the casing and forming an upward flow path when the drain outlet communicates with the connecting port, and wherein the downstream opening, which is open to the interior of the casing, is configured, relative to the interior of the casing, such that flush flowing out of the downstream opening impacts the interior of the casing with a circumferential flow component so as to generate a swirling flow within the casing, wherein the downstream opening is configured relative to the interior of the casing such that flush flowing out of the downstream opening has both a downward flow component and the circumferential flow component such that a downward swirling flow is initiated upon impact, and wherein the interior of the casing has a surface that is inclined and extends radial inward such that the swirling flow is directed radially inward following impact.

2. The drainage connector as recited in claim 1 wherein the flow inlet of the casing and flow outlet of the casing have respective centers along a vertical axis.

3. The drainage connector according to claim 1, wherein the downward flow path includes a lowermost part having an upper end and the upward flow path includes an uppermost part having a lower end, and the lower end of the uppermost part of the upward flow path is located at an identical horizontal position with or higher than the upper end of the lowermost part of the downward flow path when the drain outlet communicates with the connecting port.

4. The drainage connector according to claim 1 wherein the casing has a horizontal section that is substantially annular.

5. The drainage connector according to claim 1, wherein the casing has an inner surface including a downwardly inclined surface directed toward the flow outlet thereof.

6. The drainage connector according to claim 1, wherein the casing has an upper surface formed with the flow inlet and an underside formed with the flow outlet, the flow inlet and flow outlet both having respective centers aligned with each other.

* * * * *